US007334370B2

(12) United States Patent
Fordyce et al.

(10) Patent No.: US 7,334,370 B2
(45) Date of Patent: Feb. 26, 2008

(54) ANCHOR FOR METAL FENCE POST

(76) Inventors: Patrick R. Fordyce, 1170 Salt Creek Rd., Hilger, MT (US) 59451; Wade M. Wolf, 6855 Sourdough Canyon Rd., Bozeman, MT (US) 59715

( * ) Notice: Subject to any disclaimer, the term of this patent is extended or adjusted under 35 U.S.C. 154(b) by 551 days.

(21) Appl. No.: 10/883,506

(22) Filed: Jul. 1, 2004

(65) Prior Publication Data

US 2005/0199862 A1 Sep. 15, 2005

Related U.S. Application Data

(63) Continuation-in-part of application No. 10/796,549, filed on Mar. 9, 2004, now abandoned.

(51) Int. Cl.
*E02D 5/74* (2006.01)

(52) U.S. Cl. ..... 52/165; 256/65.14; 52/155; 52/169.9

(58) Field of Classification Search ..... 256/1, 256/21, 65.14, DIG. 5; 52/155, 165, 169.9; 29/897, 428

See application file for complete search history.

(56) References Cited

U.S. PATENT DOCUMENTS

| | | | | | |
|---|---|---|---|---|---|
| 962,632 | A | * | 6/1910 | Frost | 256/32 |
| 1,169,821 | A | | 2/1916 | Hindmarsh | |
| 1,530,330 | A | * | 3/1925 | Rowe | 52/153 |
| 1,717,557 | A | | 6/1929 | Halgrimson | |
| 1,726,526 | A | | 9/1929 | Colvin | |
| 1,774,288 | A | | 8/1930 | Nickerson | |
| 1,807,488 | A | | 5/1931 | Michalicek | |
| 1,955,902 | A | | 4/1934 | Bullard | |
| 1,965,994 | A | * | 7/1934 | Sommer | 52/153 |
| 1,968,309 | A | * | 7/1934 | Paque | 52/153 |
| 2,227,553 | A | * | 1/1941 | Paque | 52/153 |
| 2,243,886 | A | | 6/1941 | Scott | |
| 2,334,989 | A | | 11/1943 | Brickman | |
| 2,366,997 | A | | 1/1945 | Brand | |
| 2,705,548 | A | | 4/1955 | Lionberger | |
| 2,771,163 | A | | 11/1956 | Mafera, Jr. | |
| 2,910,149 | A | | 10/1959 | Lionberger | |
| 3,012,644 | A | | 12/1961 | Bush | |
| 3,017,000 | A | | 1/1962 | Hynds | |
| 3,279,136 | A | | 10/1966 | Smith | |
| 3,775,924 | A | * | 12/1973 | McClure, Jr. | 52/155 |

(Continued)

*Primary Examiner*—Gregory J. Binda
*Assistant Examiner*—Daniel J. Mills
(74) *Attorney, Agent, or Firm*—Antoinette M. Tease

(57) ABSTRACT

A fence post anchor comprising a lower portion, first and second supporting arms, and first and second main arms, made out of a single piece of material. The supporting arms wrap around the front face of a metal fence post and ensure that the anchor will bend above the supporting arms rather than at the base. The supporting arms can lie side by side in the same vertical plane or overlap and lock together with tabs and cut-outs or form a notch. The main arms can be flat or rounded at their top edge and can include folded flanges that tuck behind the front face of the fence post. The first and second main arms spread outward and provide resistance if the fence post is subject to upward pressure. A fence post anchor comprising first and second front arms and first and second rear supporting members with outwardly extending flanges.

13 Claims, 9 Drawing Sheets

U.S. PATENT DOCUMENTS

| | | | | | |
|---|---|---|---|---|---|
| 3,896,596 | A | * | 7/1975 | Berger | 52/153 |
| 4,015,433 | A | | 4/1977 | Shibata | |
| 4,027,856 | A | * | 6/1977 | Kingsley et al. | 256/47 |
| 4,663,902 | A | | 5/1987 | Abbott, Jr. | |
| 4,738,060 | A | | 4/1988 | Marthaler et al. | |
| 4,738,063 | A | | 4/1988 | Alsop | |
| 4,921,200 | A | * | 5/1990 | Moraly | 248/545 |
| 5,058,337 | A | | 10/1991 | O'Connor | |
| 5,255,480 | A | | 10/1993 | Alsop | |
| 5,428,927 | A | | 7/1995 | Webb et al. | |
| 5,553,978 | A | | 9/1996 | Bates | |
| 5,623,843 | A | | 4/1997 | Sands | |
| 6,474,028 | B2 | | 11/2002 | Cusimano et al. | |
| 2002/0088186 | A1 | | 7/2002 | Cusimano et al. | |
| 2003/0221378 | A1 | | 12/2003 | Krieger | |

* cited by examiner

ANCHOR FOR METAL FENCE POST

CROSS-REFERENCE TO RELATED APPLICATION

This application is a continuation-in-part of U.S. application Ser. No. 10/796,549, filed on Mar. 9, 2004 now abandoned.

BACKGROUND OF THE INVENTION

1. Field of the Invention

The present invention relates to the field of post anchors and, in particular, post anchors designed for use in connection with metal fence posts.

2. Description of the Related Art

A number of inventions have been patented that attempt to solve the problem of preventing a fence post from coming out of the ground. None of these inventions is as simple to install, easy to manufacture, and effective as the present invention. Some of these inventions cannot be used with contemporary metal fence posts, many of them require alteration of the fence post, and all of them consist of more than one part. The present invention, on the other hand, is designed specifically for use with modern metal fence posts, it does not require any alteration of the fence post, it provides resistance on both sides of the fence post, and it consists only of a single piece of material. For these reasons, it is superior to any of the previously patented inventions discussed below.

U.S. Pat. No. 1,169,821 (Hindmarsh, 1916) discloses a fence post constructed of sheet steel that is bent so that its general shape in cross-section is that of a V, and wherein each limb of the V is bent backward so as to form a vertical flange that lies parallel or nearly parallel with the limb of the V. According to the inventor, this shape would greatly stiffen the post so that it would resist the tendency to buckle under horizontal pressure. The lower end of the post is pointed, and barbs are located at the end of each limb of the V. Pivoting plates are optionally attached to the post to provide further resistance.

U.S. Pat. No. 1,717,557 (Halgrimson, 1928) provides a fence post anchor that mounts to the front of a steel post. The anchor device consists of four parts, namely, an attaching plate that is riveted to the post, a second plate that extends outward when the fence post is pulled upward, hinges or rings that secure the second plate to the attaching plate, and stop wings that limit the downward movement of the second plate. This particular anchor device provides resistance only on the front of the fence post.

U.S. Pat. No. 1,955,902 (Bullard, 1934) relates to an anchor device for a metal fence post. This device was designed to work with the older style of metal fence posts that do not have knobs on the front face of the post and would not likely work with today's fence posts. The device comprises a post, a tapered plate attached to the post, an abutment that extends angularly from the plate, an anchor plate that is pivotally connected to the tapered plate, and a lever. When upward force is applied to the lever, it causes an outward movement of the anchor plate, which provides the anchoring resistance.

U.S. Pat. No. 2,705,548 (Lionberger, 1955) describes another fence post anchor means. This device is designed to work with today's metal fence posts, but it requires alteration of the steel spade that is attached to the fence post. The anchor device comprises a pair of triangular movable plates that are mounted with hinges on each side of the existing spade on the front face of the fence post. These movable plates are curved downward at their tips.

Lionberger patented another fence post anchor device in U.S. Pat. No. 2,910,149 (Lionberger, 1959). This device was designed to work with modern metal fence posts, and it consists of one main flange with a pointed bite portion opposite a short side. The short side of the flange is attached to the fence post with hooks that loosely embrace the edges of the fence post. The flange also has a resilient tongue whose purpose is to accommodate the knobs or bosses that protrude from the front face of the fence post.

U.S. Pat. No. 4,663,902 (Abbott, Jr., 1987) discloses a fence post anchor that consists of a spade pivotally attached to a post and held in place by the use of a flexible strap. This particular device was designed for use with wood fence posts and is not adapted to work with modern metal fence posts.

U.S. Pat. No. 5,058,337 (O'Connor, 1991) provides a ground anchor that could be adapted for use with metal fence posts, although the patent itself does not explain how the device would attach to a metal fence post. Alteration of the fence post, or modification of the invention, would likely be required. The anchor device comprises a post, a plate of non-uniform thickness with bendable portions and a rigid portion, and a limit stop plate secured to the front face of the post.

U.S. Pat. No. 5,428,927 (Webb et al., 1995) discloses an anchor device that can be used with modern metal fence posts, but it requires alteration of the fence post for installation. The anchor device consists of an extending leg with an opening near the base end (in other words, a hole has to be drilled in the fence post), an elongated anchor with a longitudinal slot for receiving a portion of the post leg, and a pin that engages the anchor and passes through the leg opening.

In addition to the patents discussed above, which attempt to solve the problem of fence posts coming out of the ground, there are a number of patents that provide other types of anchoring devices. Although they are similar to the present invention in that their purpose is to keep something in the ground, none of these inventions possesses the simplicity of design and uniqueness of purpose of the present invention.

For example, the anchor device of U.S. Pat. No. 1,726,526 (Colvin, 1929) includes a shaft that drives the anchor device into the ground. The upper end of the shaft has an eye for the attachment of a guy line, and the lower end of the shaft has an eye through which a pivot pin is placed. Two flukes are pivotally mounted on the pin, and the shaft is surrounded by a conical enlargement that spreads the upper ends of the flukes when the guy line is pulled.

U.S. Pat. No. 1,774,288 (Nickerson, 1930) describes a rather complicated sign post anchor comprising a post, an anchor foot affixed to the post with side shoulders positioned laterally in relation to the post, a collar on the post above the side shoulders, and ground anchor arms that pivot on the collar and that engage the side shoulders when positioned horizontally. The collar is secured to the post with a pin and has cutaway portions that define spaced shoulders. The pins are positioned in relation to the spaced shoulders such that they limit rotational movement of the post and foot.

U.S. Pat. No. 1,807,488 (Michalicek, 1931) involves an anchoring device that is adapted for use in securing guy lines. The anchoring device includes a pair of arcuate sections that are transversely corrugated and that have at their upper edge an inturned flange that extends slightly downward toward the center of the device. Each arcuate section has two apertured ears, to which are connected links that are in turn pivotally connected to a floating plate at the bottom of the device. A rigid plate lies on top of the sections and has an opening through which a threaded rod is placed. The rod engages with an internally threaded boss and connects the anchor device to the object it is intended to secure. Rotation of the rod causes the two sections to be forced apart, which provides the anchoring resistance.

U.S. Pat. No. 2,334,989 (Brickman, 1943) discloses a metal highway guard support with two parallel flanges connected by a median web. The roadside flange connects to a resilient steel bracket that carries a plurality of cables to jointly form the guard rail element. A wing-like anchor plate is pivotally connected to the roadside flange through apertures in the flange. The anchor plate has a depending tongue that serves to stop the pivotal movement of the plate. The anchor plate is the same width as the roadside flange at its base but wider than the flange at its upper end.

U.S. Pat. No. 2,243,886 (Scott, 1941) provides an airplane mooring anchor that operates by means of an anchor rod that sits inside of a driving tube. When the driving tube is raised, it causes the two portions of the anchoring root element to spread apart. The driving tube is then removed and a mooring eye is threaded onto the upper end of the anchor rod.

U.S. Pat. No. 2,366,997 (Brand, 1945) involves a ground stake comprising a tubular shank, a pair of tapered flukes, and a pull cord. The pull cord is attached to the pivot of the flukes, directed over a pulley, and provided with a ring at its free end for attachment to a guy wire, tent rope, or other object that is to be anchored. U.S. Pat. No. 2,771,163 (Mafera, Jr., 1956) relates to a ground anchor that is comprised of a stake that is pointed at one end and that has at least one transverse slot. A fluke is placed into each transverse slot, and when the ground anchor is subjected to dislodging strains, the flukes move outward at right angles to the stake. Each stake wall has a hole for receiving guy lines.

U.S. Pat. No. 3,012,644 (Bush, 1961) describes an anchor pile that operates by means of a steel cable. The anchor pile comprises a hollow elongated body adapted to be driven into the ground, openings in the side of the elongated body, anchoring flukes pivotally connected to the body and adapted to spread outwardly, shoulders on the flukes, and means for collapsing the flukes against the side of the body. The means for collapsing the flukes extends through the openings in the side of the body and upwardly inside the hollow body.

U.S. Pat. No. 3,107,000 (Hynds, 1962) discloses another land anchor that requires an internal mechanism for its operation. The anchor comprises a shaft connected to a holding line at its upper end, a sleeve that surrounds the shaft and that can slide up and down on the shaft, and one or more flukes that are pivotally connected to the shaft. When the shaft is pulled upward, it causes the flukes to spread outward.

U.S. Pat. No. 3,279,136 (Smith, 1966) describes an umbrella pile anchor with flukes that open outward in a direction opposite that of the present invention. Specifically, the tips of the flukes move from bottom to top upon opening, rather than from top to bottom, as is the case with all of the other anchoring devices discussed herein. This particular anchor device was designed for use in a shipyard and cannot be installed on a fence post. As with U.S. Pat. No. 3,012,644 and U.S. Pat. No. 3,107,000, this anchor device requires an internal mechanism to open the flukes. In this case, the internal mechanism is an inner follower tube that sits inside of an outer follower tube.

U.S. Pat. No. 4,015,433 (Shibata, 1977) describes a method for settling an anchor device in the ground involving deep shafts that are bored into the ground. The method involves pulling a release line to rotate cutting arms that are attached to the shaft.

U.S. Pat. No. 4,738,060 (Marthaler et al., 1988) provides a marker assembly for permanently locating underground utility elements. The marker assembly includes a non-removable plastic stake and a flat marker that sits above ground. The underground part of the stake has a pair of flexible barbs that serve to grip the earth and hold the marker in position.

U.S. Pat. No. 4,738,063 (Alsop, 1988) discloses a ground anchoring system in which a generally flat anchor plate is secured to one end of a flexible anchor line and driven edge-first into the ground by a driving tool. According to the inventor, when the driving tool is removed and a lifting force is applied, the anchor plate tends to "skew" across the hole and resist extraction. This particular patent was intended to cover improvements devised by the inventor to prevent the anchor plate from rising back up the hole when the lifting force is applied. In U.S. Pat. No. 5,255,480 (Alsop, 1993), the inventor added a spring mechanism designed to force the anchor plates open.

U.S. Pat. No. 5,553,978 (Bates, 1996) provides a pivotable anchor for pilings. The anchor comprises a backing plate that is secured to the lower exterior portion of the piling, a pivot bracket that extends laterally out from the backing plate, a pivoting arm and a thrust plate.

U.S. Pat. No. 5,623,843 (Sands, 1997) relates to an anti-theft motorcycle tethering device that can be driven through asphalt, tarmac or pavement. The device consists of a solid metal stake with collapsible barbs that retract while the stake is being driven into the ground and deploy after the stake is in the ground. The upper end of the stake is adapted to permit a motorcycle to be tethered to it.

U.S. Pat. No. 6,474,028 (Cusimano et al., 2002) and U.S. Patent Application Pub. No. 2002/0088186 (Cusimano et al.) both involve a ground anchor designed to secure modular buildings exposed to earthquake, high winds and floods. The ground anchor comprises a heavy steel rod with several inches of machine threading and an arrowhead with a pair of wedge-shaped wings, a pivotal fluke that is hinged to the shaft with a lateral pin, a stabilizer vane that slips down over the threaded portion of the steel rod, and a cap that interlocks with the stabilizer vane.

Finally, U.S. Patent Application Pub. No. 2003/0221378 (Krieger) describes elongated tethering stakes with pivotally connected claws that extend outward when upward pressure is placed on the stakes. The stakes are connected at their impact end to a securing line. This particular invention was intended for use in securing animals or goods to a particular location.

As is clear from the above discussion, although the concept of using flanges or flukes to oppose the upward pressure of a rod or stake is known in the art, no one has ever patented a fence post anchor that is designed to work with modern metal fence posts, that requires no alteration of the existing fence post, that provides resistance on both sides of the fence post by virtue of two extending arms, and that is made from a single piece of material.

BRIEF SUMMARY OF THE INVENTION

The present invention is a fence post anchor comprising a lower portion, first and second supporting arms, and first and second main arms—all made out of a single piece of material. When installed, the first and second supporting arms wrap around the front face of a metal fence post, and the first and second main arms prevent the fence post from rising up out of the ground after the fence post has been driven into the ground. The first and second main arms are configured such that they will spread outward and provide resistance if the fence post is subject to upward pressure. The first and second supporting arms ensure that if the fence post is pulled upward, the anchor will bend at a point above the supporting arms rather than at the base of the anchor, which would cause the anchor to dislodge from the fence post.

In one embodiment, the first supporting arm is closer to the bottom end of the anchor than the second supporting arm, such that when the anchor is installed, the first and second supporting arms lie in the same vertical plane and do not overlap. In this embodiment, the first and second supporting arms fit between any two contiguous knobs of the front face of the metal post, and the first and second supporting arms do not extend horizontally beyond the knobs. The top portion of the first and second main arms extends horizontally beyond the front face of the metal fence post, and the top edge of the top portion can be flat or rounded.

In another embodiment, the first supporting arm comprises one or more tabs, and the second supporting arm comprises one or more cut-outs. As in the first embodiment, the first and second supporting arms are wrapped around the front face of the fence post, but in this embodiment, the first and second supporting arms are equidistant from the base of the anchor, which means they overlap with one another when the fence post anchor is installed. Each tab of the first supporting arm is bent over the second supporting arm and through a cut-out in the second supporting arm. Also in this embodiment, each main arm has a folded flange that is folded inward toward the metal post and tucked in behind the front face of the metal post.

In an alternate embodiment, the fence post anchor is made of a single piece of material and comprises a first front arm, a second front arm, a first rear support member, and a second rear support member. The first front arm is V-shaped with a notch at the bottom of the V. The second front arm has two upward extensions that form a notch. These two upward extensions prevent dirt from getting underneath the first front arm when the post is driven into the ground. The notch formed by the two upward extensions holds a knob on the front face of the metal fence post and prevents the anchor from coming off when the metal fence post is driven into the ground. When the metal fence post is pulled upward, this same knob engages the first front arm at the bottom of the V, thereby forcing the first front arm to open and the first and second rear support members to bend away from the metal fence post.

The first rear support member is longer than the second rear support member, which lies flat against the back end of the metal fence post. The first rear support member wraps around the bottom of the back end of the metal fence post and up the other side, on top of the first rear support member. Both the first and second rear support members have outwardly extending flanges that provide pressure against the ground and force the anchor to open when the metal fence post is pulled upward.

In yet another embodiment, the anchor comprises a single front arm, first and second rear support members with flanges, and gussets that extend outwardly from the first and second rear support members. The purpose of the gussets is to prevent the anchor from opening further when the flanges extend outward in response to upward pressure on the fence post. The flanges include triangular stops to prevent the flanges from lying flat against the back end of the metal fence post when the post is driven into the ground.

The present invention can be made out of any material suitable for the purposes described herein, including, but not limited to, stainless steel, hot or cold rolled mild steel, galvanized metal, aluminum and plastic. The present invention is easily manufactured by cutting the material in a pattern that can be folded into the shape of the fence post anchor and then folding the cut material into the appropriate shape for the particular embodiment.

REFERENCE NUMBERS

Figures 1, 2, 3:
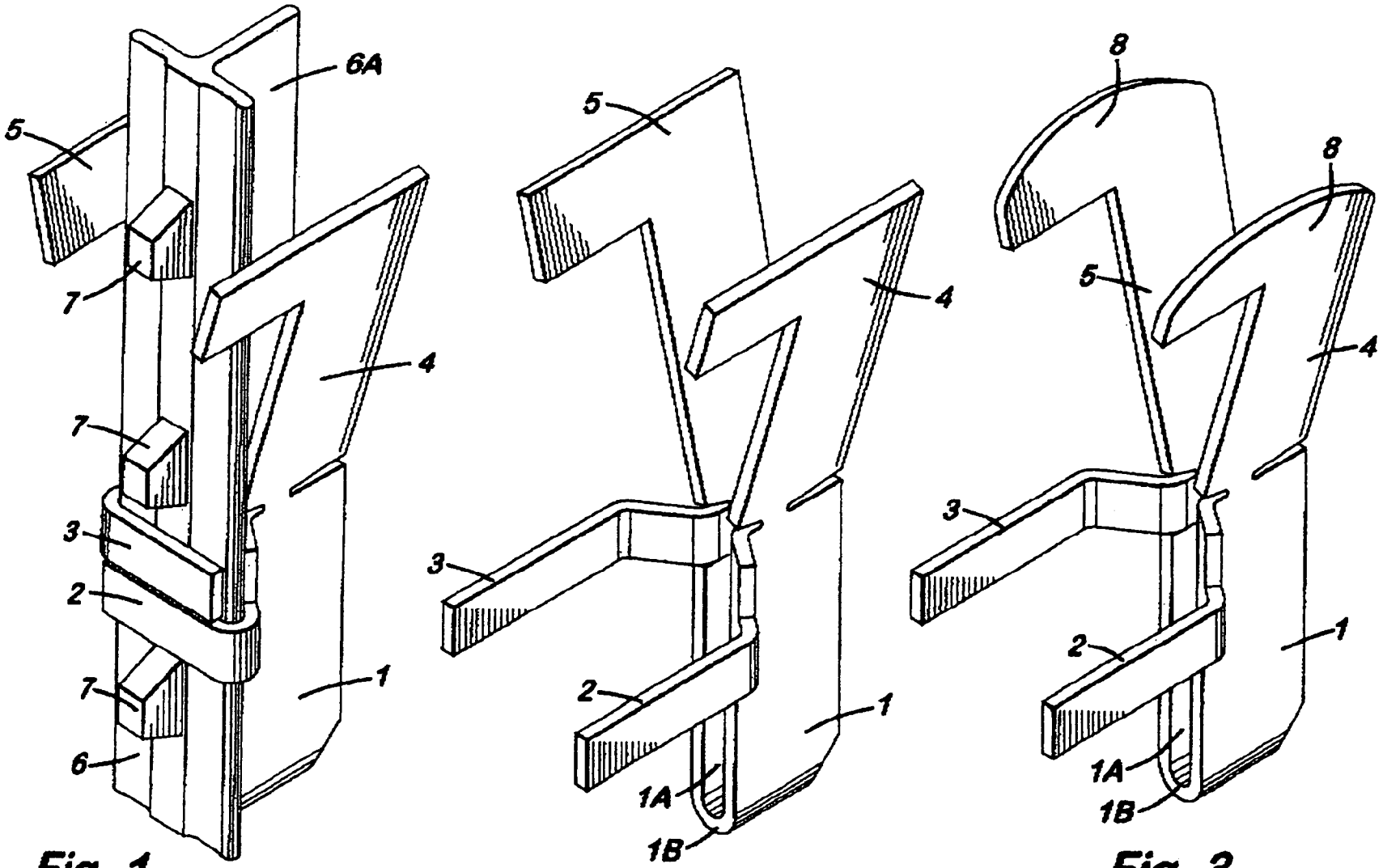
FIG. 1 is a perspective view of the first embodiment of the present invention as it is installed on a metal fence post.
FIG. 2 is a perspective view of the first embodiment of the present invention before it is installed on a metal fence post.
FIG. 3 is a perspective view of the second embodiment of the present invention.

1 Lower portion
1A "U" formed by lower portion
1B Bottom end (or base) of lower portion
2 First supporting arm
2A Tab of first supporting arm
3 Second supporting arm
3A Cut-out of second supporting arm
4 First main arm
4A Folded flange of first main arm (or first folded flange)
5 Second main arm
5A Folded flange of second main arm (or second folded flange)
6 Front face of metal fence post
6A Back end of metal fence post
7 Knob
8 Top edge of main arms
9 Beveled edge
10 Downward extension
11 Notch formed by downward extensions
12 First front arm
13 Notch in first front arm
14 Second front arm
15 Upward extensions of second front arm
16 Notch formed by upward extensions
17 First rear support member
18 Second rear support member
19 Flanges of rear support members
20 Front arm
21 Gusset
22 Triangular stop

DETAILED DESCRIPTION OF INVENTION

The uniqueness of the present invention lies in the fact that it is constructed of a single piece of material, requires no alteration of the existing fence post, and can be installed easily by bending two supporting arms. It is these features that distinguish the present invention from any of the prior art. Several different embodiments are depicted in the drawings and discussed below, but each of them shares these unique features.

FIG. 1 is a perspective view of the first embodiment of the present invention as it is installed on a metal fence post. The present invention comprises a lower portion 1 that is connected to a first main arm 4 and a second main arm 5. Each of the main arms is in the shape of an upside-down "L." Extending from the lower portion 1 are a first supporting arm 2 and a second supporting arm 3, both of which wrap around the front face of the fence post 6. When the present invention is installed, the first supporting arm 2 lies directly beneath the second supporting arm 3 and on the same vertical plan as the second supporting arm 3. The present invention is configured such that both of the supporting arms can fit between a pair of knobs 7 on the fence post. This first embodiment of the present invention is also configured so that the supporting arms 2, 3 do not extend horizontally beyond the fence post knobs 7. This particular configuration ensures that the supporting arms 2, 3 will not be bent or dislodged by rocks or other hard objects when the fence post is pounded or driven into the ground.

FIG. 2 is a perspective view of the first embodiment of the present invention before it is installed on a metal fence post. To install the present invention, the back end 6A of the fence post is first inserted into the "U" formed by the lower portion 1A of the present invention. The supporting arms 2, 3 are bent so that they wrap around the front face of the fence post 6. With the present invention installed, the fence post can be pounded or driven into the ground. When the fence post is subject to upward pressure, the main arms 4, 5 spread outward and away from the metal fence post, providing resistance to the upward pressure. The presence of the supporting arms ensures that the present invention will bend at the point above the second supporting arm 3, not at the base of the lower portion 1B.

FIG. 3 is a perspective view of the second embodiment of the present invention. In this embodiment, the top edge 8 of the main arms 4, 5 is rounded rather than straight. All other aspects of this second embodiment are the same as in the first embodiment.

Figure 4:
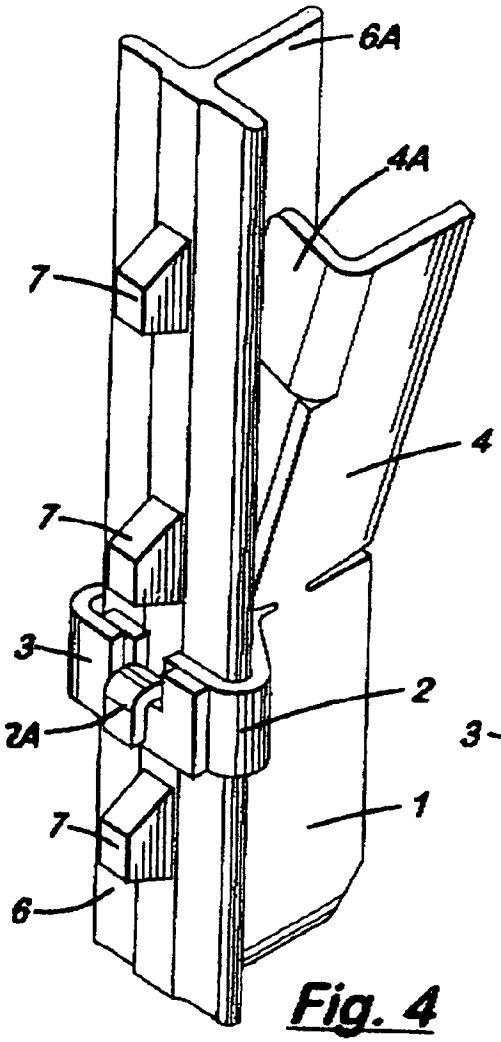
FIG. 4 is a perspective view of the third embodiment of the present invention as it is installed on a metal fence post.

FIG. 4 is a perspective view of the third embodiment of the present invention as it is installed on a metal fence post. This embodiment differs from the first and second embodiments in two respects. First, the second and third supporting arms 2, 3 are equidistant from the bottom end of the lower portion 1B. Thus, the second supporting arm 3 lies directly on top of the first supporting arm 2 when this embodiment is installed. The first supporting arm 2 includes a tab 2A that is folded down over the second supporting arm 3. The purpose of the tab 2A is to keep the two supporting arms in place and to prevent them from being dislodged when the fence post experiences upward pressure.

The second aspect in which this third embodiment differs from the first two embodiments is that the folded flanges 4A, 5A of the first and second main arms 4, 5 are folded inward toward the metal fence post and tucked behind the front face of the fence post 6. This feature is intended to keep the present invention from collapsing against the fence post when the post is driven into the ground. In the first and second embodiments, the fact that the top portion of the main arms 4, 5 extends horizontally beyond the front face of the fence post 6 accomplishes this same purpose; in other words, it forces the main arms to remain in an open position as the fence post is driven into the ground.

Figure 5:
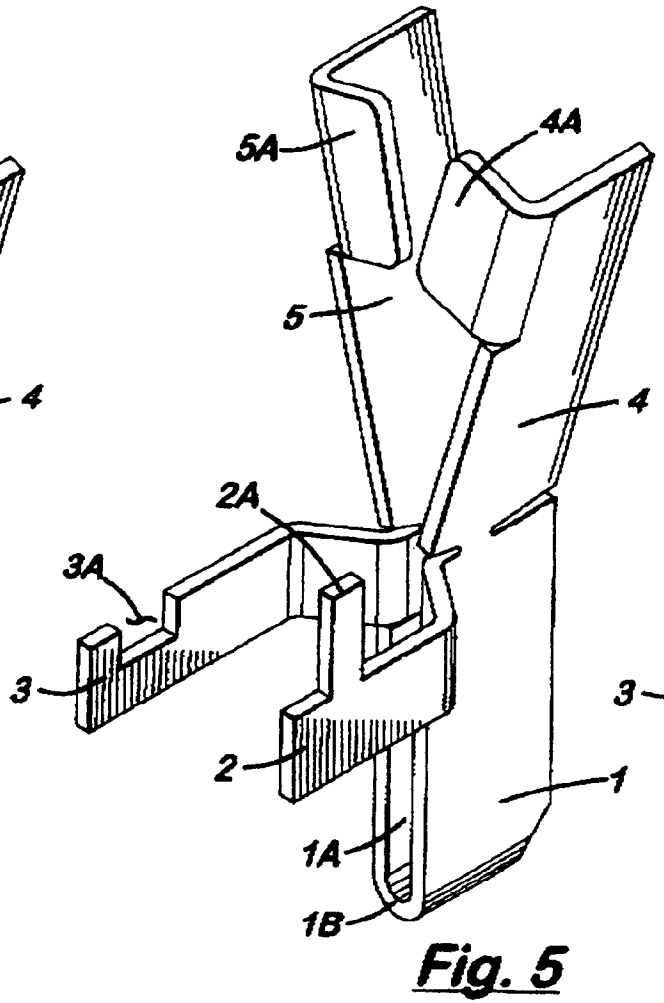
FIG. 5 is a perspective view of the third embodiment of the present invention before it is installed on a metal fence post.

FIG. 5 is a perspective view of the third embodiment of the present invention before it is installed on a metal fence post. As is apparent from this figure, the first step in installing this embodiment is to wrap the first supporting arm 2 around the front face of the metal fence post 6. The second step is to wrap the second supporting arm 3 around the front face of the metal fence post 6 and position it directly on top of the first supporting arm 2. The tab 2A of the first supporting arm 2 should line up with the cut-out 3A of the second supporting arm 3. Next, the tab 2A of the first supporting arm 2 is bent over the second supporting arm 3 and through the cut-out 3A of the second supporting arm 3. This last step completes installation of this third embodiment.

Figure 6:
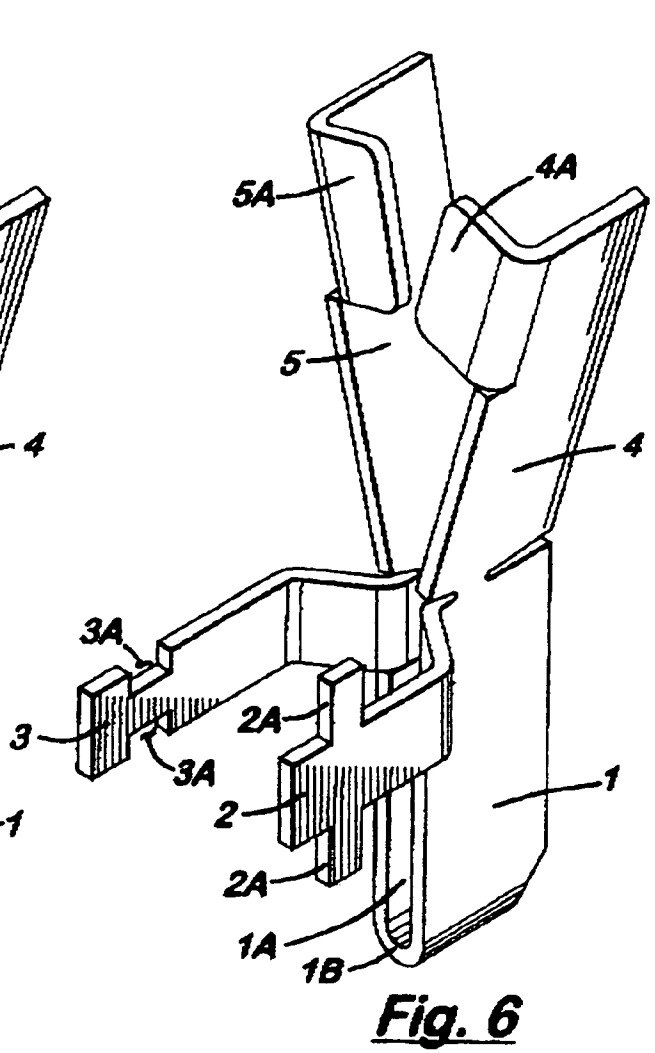
FIG. 6 is a perspective view of the fourth embodiment of the present invention before it is installed on a metal fence post.

FIG. 6 is a perspective view of the fourth embodiment of the present invention before it is installed on a metal fence post. In this fourth embodiment, the first supporting arm 2 has two tabs 2A instead of one, and the second supporting arm 3 has two cut-outs 3A instead of one. In order to avoid overlapping the tabs and thereby increasing the profile of the present invention, the tabs 2A are shorter than in FIGS. 4 and 5, and the cut-outs 3A are not as deep as shown in FIGS. 4 and 5. In addition, the width of the supporting arms may need to be increased in relation to the embodiment shown in FIGS. 4 and 5 so that the second supporting arm 3 will still retain sufficient strength to hold the fence post anchor together after the two cut-outs 3A are made. This increase in width of the supporting arms 2, 3 may make this particular embodiment more difficult to install than the other embodiments. All other aspects of this fourth embodiment are the same as in the third embodiment.

Figure 7:
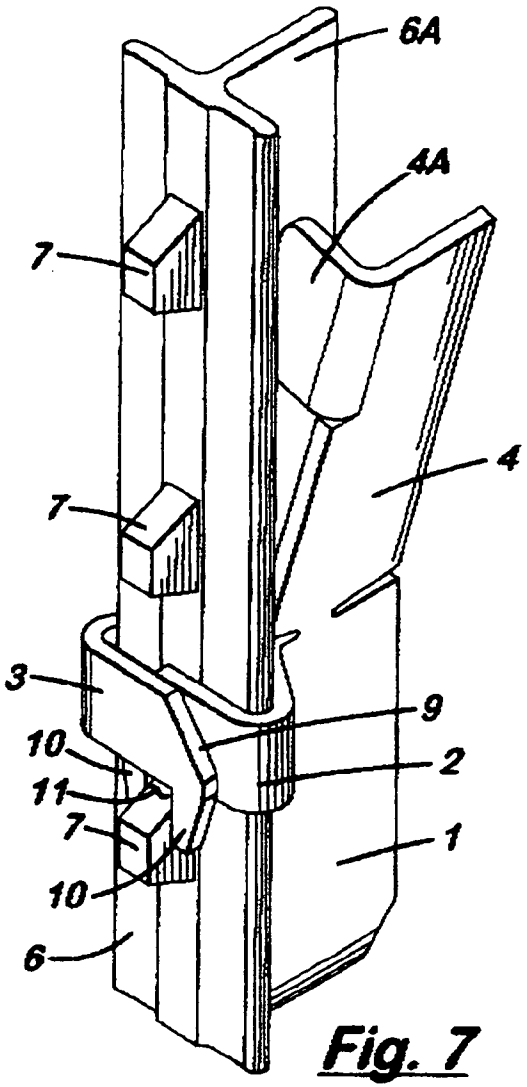
FIG. 7 is a perspective view of the fifth embodiment of the present invention as it is installed on a metal fence post.

FIG. 7 is a perspective view of the fifth embodiment of the present invention as it is installed on a metal fence post. The fifth embodiment is a variation of the third and fourth embodiments. In this embodiment, each supporting arm 2, 3 comprises a beveled edge 9 and a downward extension 10 rather than tabs 2*a* and cut-outs 3*a*. The first supporting arm 2 is bent so that it will fold underneath the second supporting arm 3, as depicted in FIG. 7. The downward extensions are positioned such that they form a notch 11 into which the knob 7 directly beneath the notch 11 will fit. If the fence post 6 is subject to upward pressure, the knob 7 will move upward and into the notch 11, which will lock the anchor in place and prevent it from bending at the base of the lower portion 1B. As in the third and fourth embodiments, the main arms 4, 5 comprise folded flanges 4A, 5A that tuck in behind the front face of the metal fence post 6. Alternatively, the main arms could be straight as shown in FIGS. 1 and 2.

Figure 8:
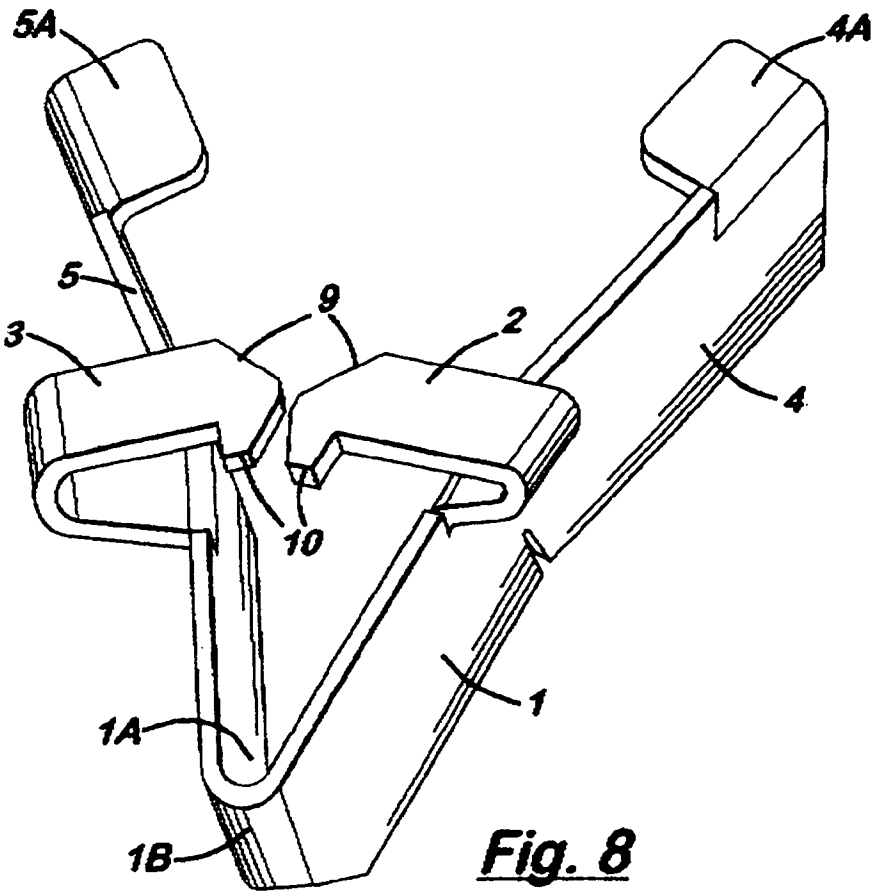
FIG. 8 is a perspective view of the fifth embodiment of the present invention before it is installed on a metal fence post.

FIG. 8 is a perspective view of the fifth embodiment of the present invention before it is installed on a metal fence post. As is apparent from this figure, the pre-installation version of this embodiment is not folded as tightly together as the other embodiments. The "U" formed by the lower portion 1A is wider than in other embodiments, and the main arms 4, 5 are not as close together. To install this embodiment, the back end 6A of the metal fence post is placed inside the "U" formed by the lower portion 1A, and the metal fence post and anchor are driven into the ground. The driving force will cause the anchor to fold closer together and the notch 11 to form, as shown in FIG. 7.

Figure 11:
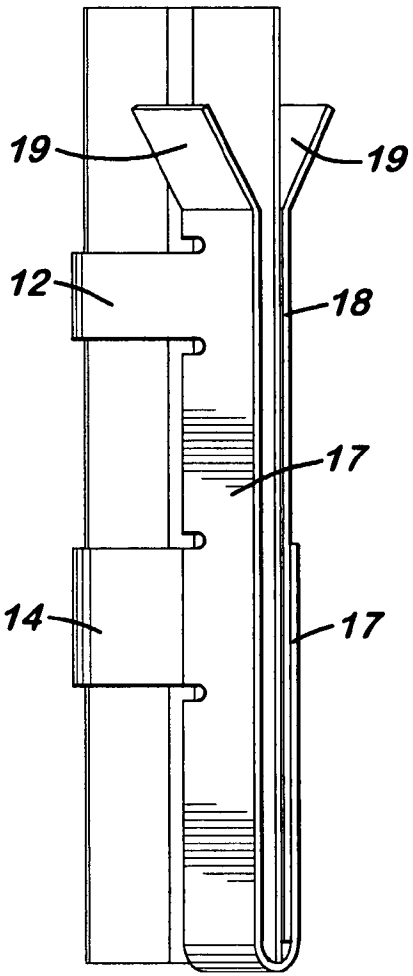
FIGS. 9, 10 and 11 are different perspective views of the sixth embodiment of the present invention as it is installed on a metal fence post.
Figure 10:
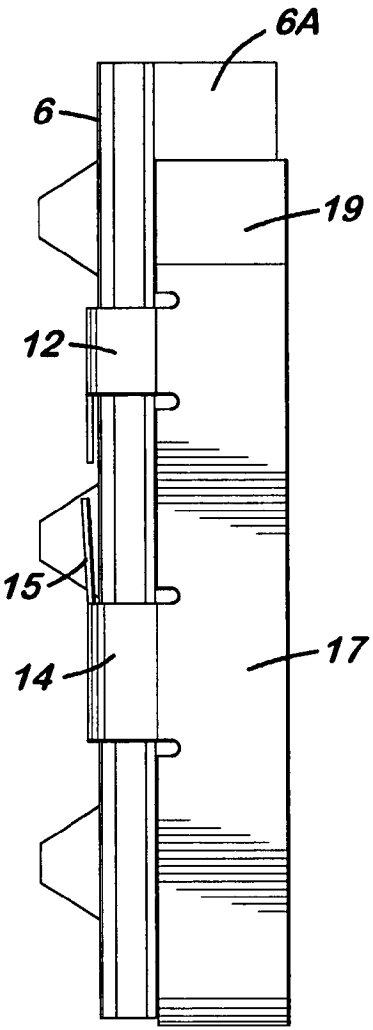
Figure 9:
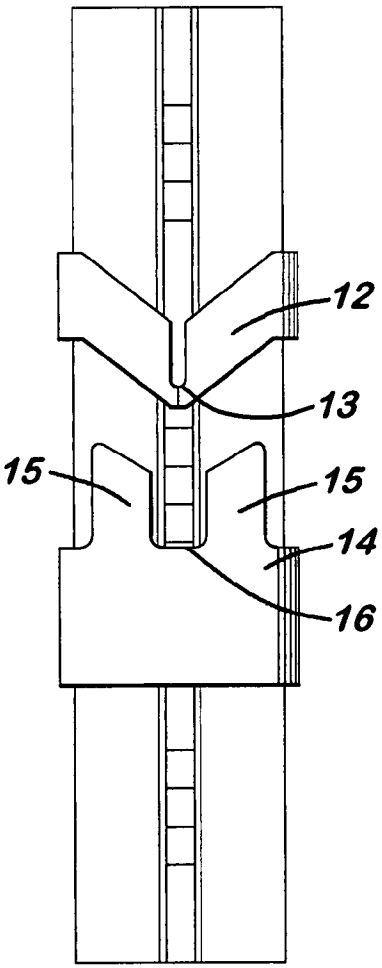

FIGS. 9, 10 and 11 are different perspective views of the sixth embodiment of the present invention as it is installed on a metal fence post. In this embodiment, as shown in FIG. 9, there is a first front arm 12 and a second front arm 14. The first front arm 12 is V-shaped and forms a notch 13 at the bottom of the V. The second front arm 14 has two upward extensions 15, which form a notch 16 through which a knob 7 in the metal fence post will fit. The main purpose of the second front arm 14 is to keep the anchor on the fence post. The notch 16 in the second front arm 14 prevents the anchor from moving upward on the metal fence post as it is driven into the ground. In addition, the two upward extensions 15 of the second front arm 14 prevent dirt from getting underneath the first front arm 12 as the fence post is driven into the ground.

As the metal fence post is pulled upward, the knob that had been resting in the notch 16 in the second front arm 14 slides upward and engages the bottom of the V of the first front arm 12. This pressure on the bottom of the V of the first front arm 12, together with the pressure of the ground against the flanges 19 of the first and second rear supporting members 17, 18, causes the first front arm 12 to open into a horizontal position. When this happens, the first and second rear support members 17, 18 will bend away from the metal fence post at a point above the second front arm 14 but below the first front arm 12, thereby providing a greater area of resistance against the ground.

FIG. 10 provides a side view of this embodiment. It shows the first rear support member, which wraps around the bottom of the back end of the metal fence post 6A and up the other side of the back end of the metal fence post (not shown in this figure). This figure also shows the knob 7 of the metal fence post cradled between the two upper extensions 15 of the second front arm 14. As can be seen in this figure, the V of the first front arm 12 rests close to the front face of the metal fence post 6, between the knobs 7, and neither the first front arm nor the second front arm extends horizontally beyond the knobs 7 on the front face of the metal fence post 6.

FIG. 11 shows the first rear support member 17 wrapped around the bottom of the back end of the metal fence post 6A and up the other side of the back end of the metal fence post, on the outside of the second rear support member 18. It also shows the two outwardly extending flanges 19 at the top of each rear support member 17, 18. The purpose of these flanges is to provide pressure against the ground and force the anchor to open when the metal fence post is pulled upward.

Figure 12:
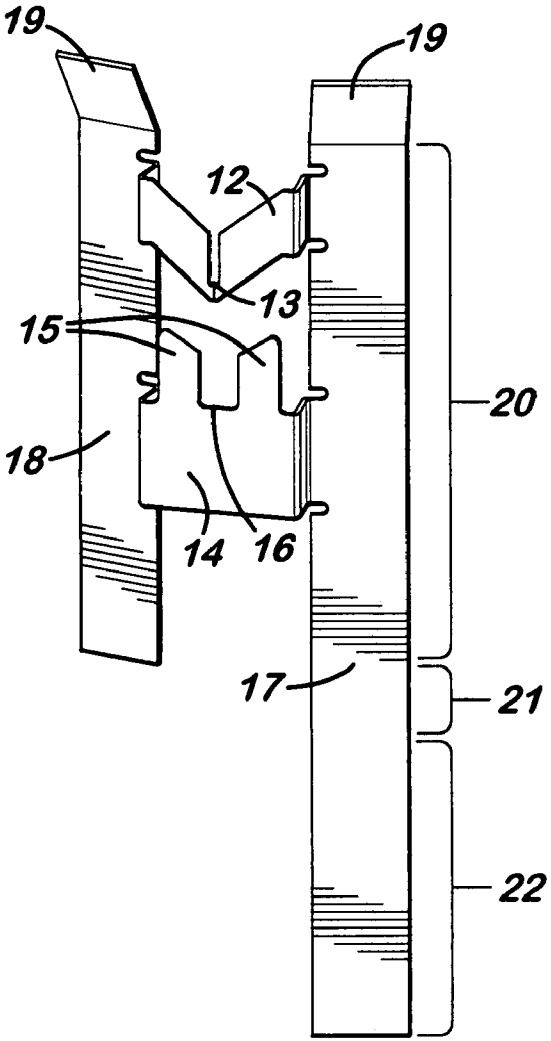
FIG. 12 is a perspective view of the sixth embodiment of the present invention before it is installed on a metal fence post.

FIG. 12 is a perspective view of the sixth embodiment of the present invention before it is installed on a metal fence post. This figure shows the first front arm 12, the notch in the first front arm 13, the second front arm 14, the two upward extensions 15 of the second front arm, and the notch 16 formed by the two upward extensions of the second front arm. It also shows the first rear support member 17, the second rear support member 18, and the flanges 19 of the first and second rear support members. When this embodiment is installed on a metal fence post, the first portion 20 of the first rear support member 17 lies flat against the back end of the metal fence post 6A, the second portion 21 of the first rear support member 17 wraps around the bottom of the back end of the metal fence post 6A, and the third portion 22 of the first rear support member 17 lies flat against and on top of the second rear support member 18.

Figure 14:
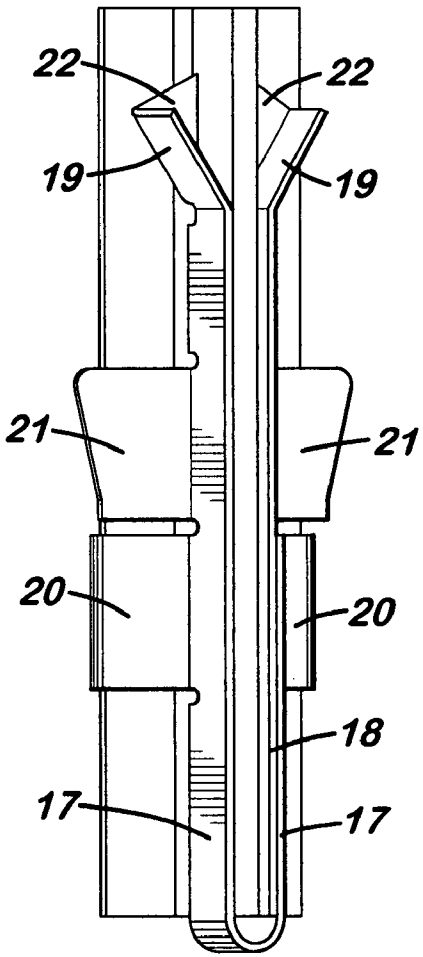
FIGS. 13 and 14 are different perspective views of the seventh embodiment of the present invention as it is installed on a metal fence post.
Figure 13:
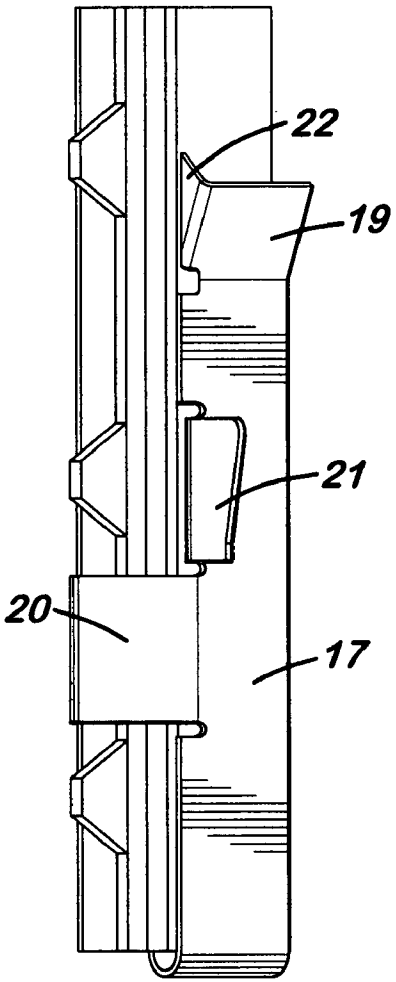

FIGS. 13 and 14 are different perspective views of the seventh embodiment of the present invention as it is installed on a metal fence post. In this embodiment, as in the sixth embodiment, the fence post anchor has a first rear supporting member 17 and a second rear supporting member 18 with outwardly extending flanges 19 at the top. There is only one front arm 20, the purpose of which is to hold the anchor onto the fence post. Immediately above the front arm 20 are two gussets 21 extending from each rear support member 17, 18. The gussets 21 serve to stop the anchor from opening further when the metal fence post is pulled out of the ground and the flanges 19 cause the anchor to open horizontally. When the post is pulled upward and the flanges open horizontally, the first and second rear support members will also bend outwardly at a point just above the front arm 20. A triangular stop 22 extends from each of the flanges 19 and tucks in behind the front face 6 of the metal fence post. The purpose of the triangular stops 22 is to ensure that the flanges 19 do not fold flat against the fence post when the fence post is driven into the ground.

Figure 15:
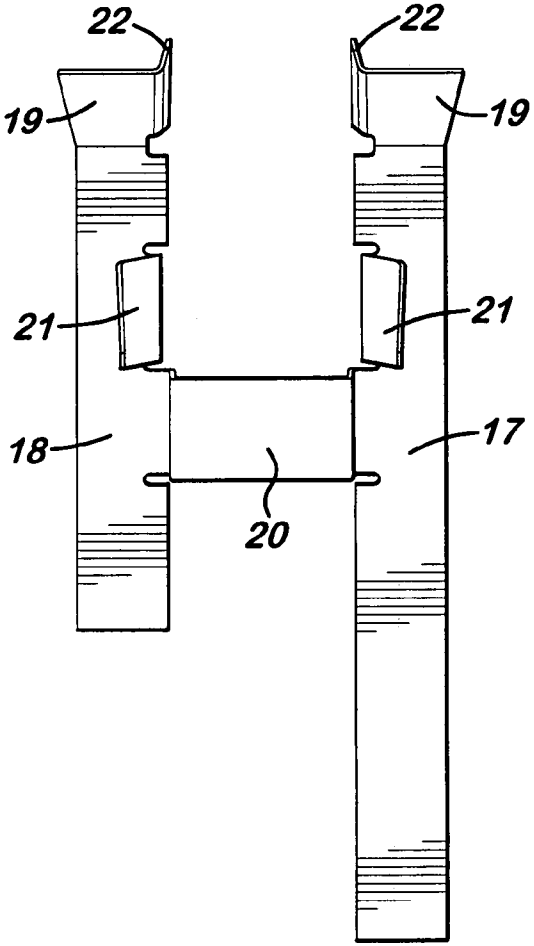
FIG. 15 is a perspective view of the seventh embodiment of the present invention before it is installed on a metal fence post.

FIG. 15 is a perspective view of the seventh embodiment of the present invention before it is installed on a metal fence post. This figure illustrates all of the features that have been discussed previously in connection with FIGS. 13 and 14.

Figure 16:
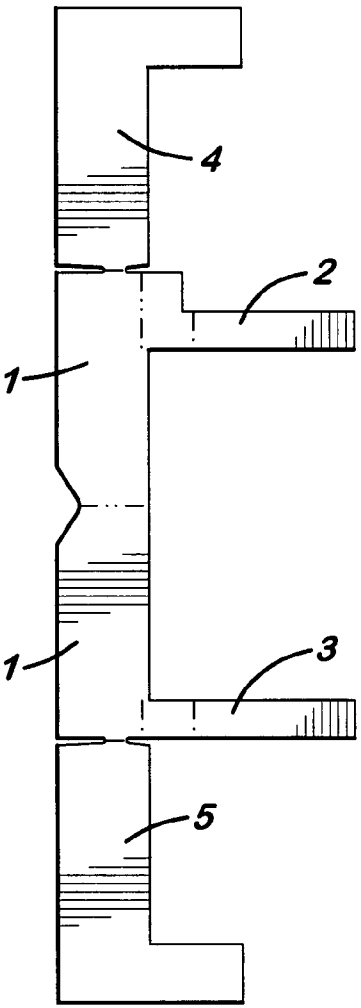
FIG. 16 is a flat pattern view of the first embodiment of the present invention.

FIG. 16 is a flat pattern view of the first embodiment of the present invention. This figure illustrates the shape of the one-piece material that forms the first embodiment of the present invention before it is folded into the configuration shown in FIG. 2. The dotted lines of FIG. 9 indicate where the material is folded to form the pre-installation product shown in FIG. 2.

Figure 17:
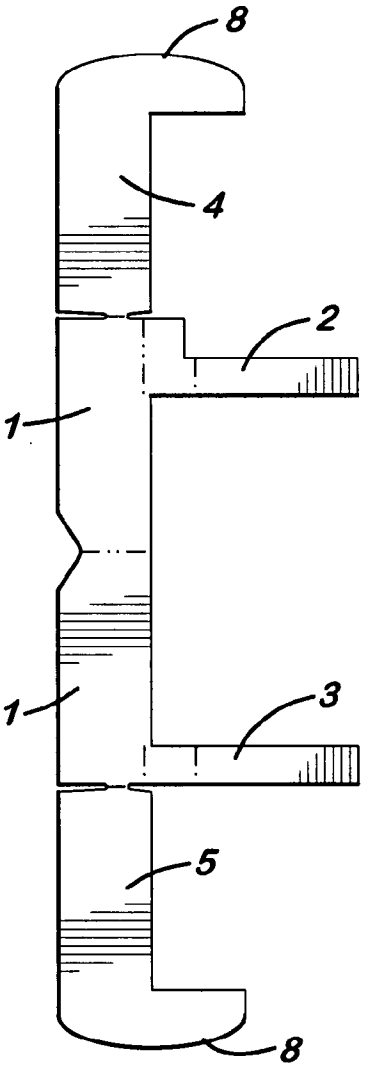
FIG. 17 is a flat pattern view of the second embodiment of the present invention.

FIG. 17 is a flat pattern view of the second embodiment of the present invention. This figure illustrates the shape of the one-piece material that forms the second embodiment of the present invention before it is folded into the configuration shown in FIG. 3. The dotted lines of FIG. 10 indicate where the material is folded to form the pre-installation product shown in FIG. 3.

Figure 18:
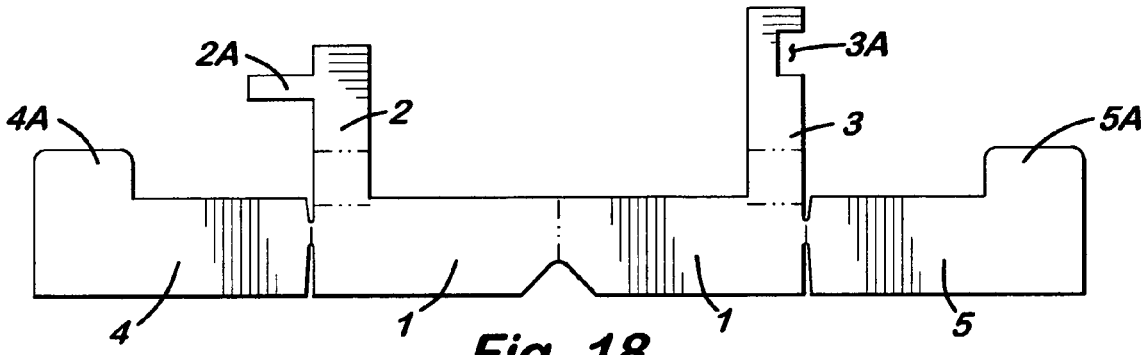
FIG. 18 is a flat pattern view of the third embodiment of the present invention.

FIG. 18 is a flat pattern view of the third embodiment of the present invention. This figure illustrates the shape of the one-piece material that forms the third embodiment of the present invention before it is folded into the configuration shown in FIG. 5. The dotted lines of FIG. 11 indicate where the material is folded to form the pre-installation product shown in FIG. 5.

Figure 19:
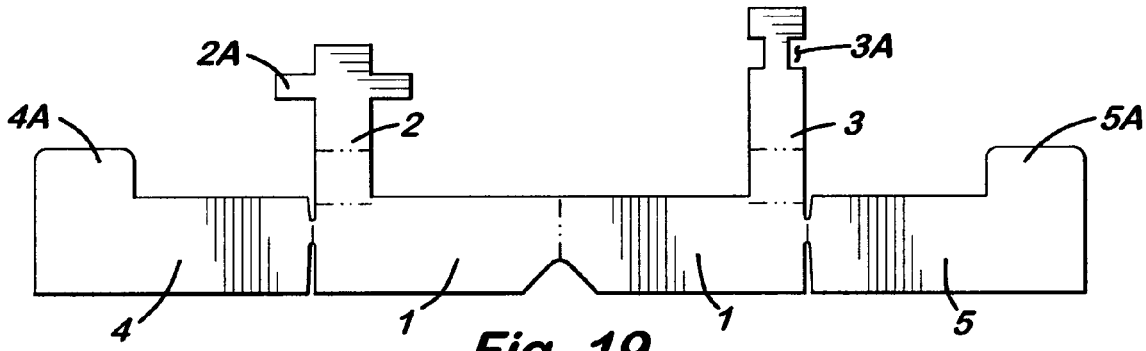
FIG. 19 is a flat pattern view of the fourth embodiment of the present invention.

FIG. 19 is a flat pattern view of the fourth embodiment of the present invention. This figure illustrates the shape of the one-piece material that forms the fourth embodiment of the present invention before it is folded into the configuration shown in FIG. 6. The dotted lines of FIG. 12 indicate where the material is folded to form the pre-installation product shown in FIG. 6.

Figure 20:
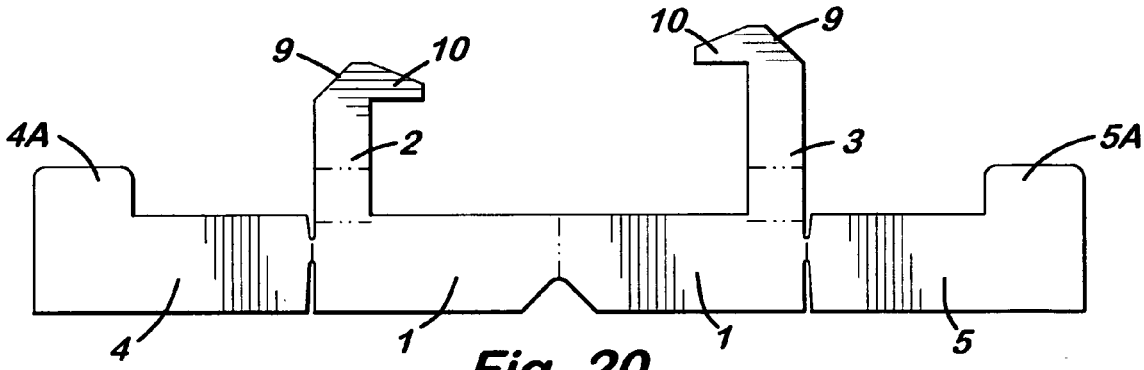
FIG. 20 is a flat pattern view of the fifth embodiment of the present invention.

FIG. 20 is a flat pattern view of the fifth embodiment of the present invention. This figure illustrates the shape of the one-piece material that forms the fifth embodiment of the present invention before it is folded into the configuration shown in FIG. 8. The dotted lines of FIG. 10 indicate where the material is folded to form the pre-installation product shown in FIG. 8. As is shown in FIGS. 7 and 13, when the first supporting arm 2 is slightly shorter than the second supporting arm 3, then the knob 7 fits squarely within the notch 11 created by the first and second supporting arms. In a slightly different version of this embodiment, the two supporting arms could be the same length, and the notch would be slightly wider on the side of the notch 11 that corresponds to whichever supporting arm was folded underneath the other.

Figure 21:
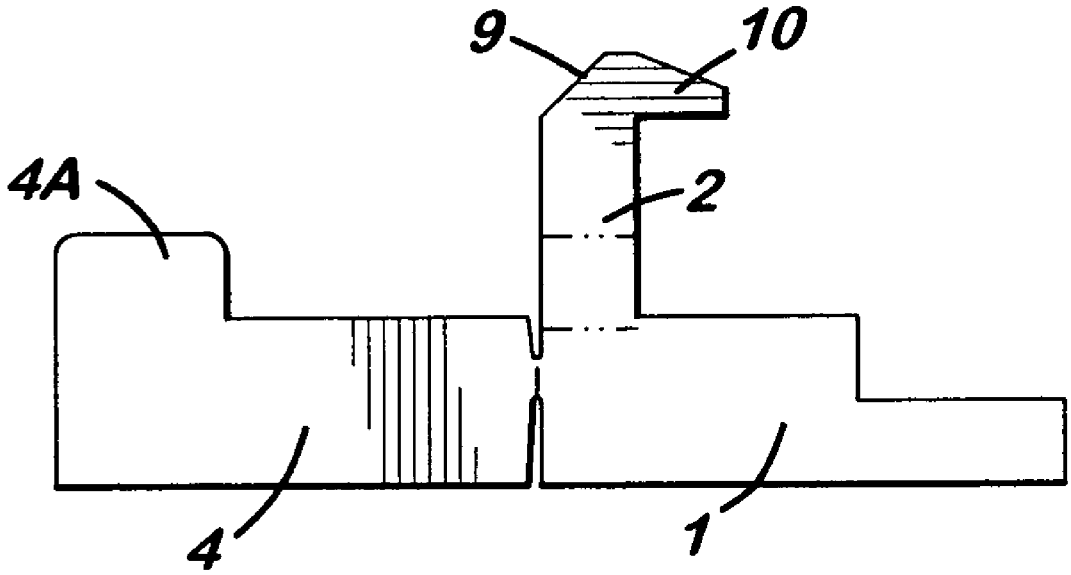
FIGS. 21 and 22 are flat pattern views of the fifth embodiment cut in half to allow a user to use only one side or the other of the fence post anchor.
Figure 22:
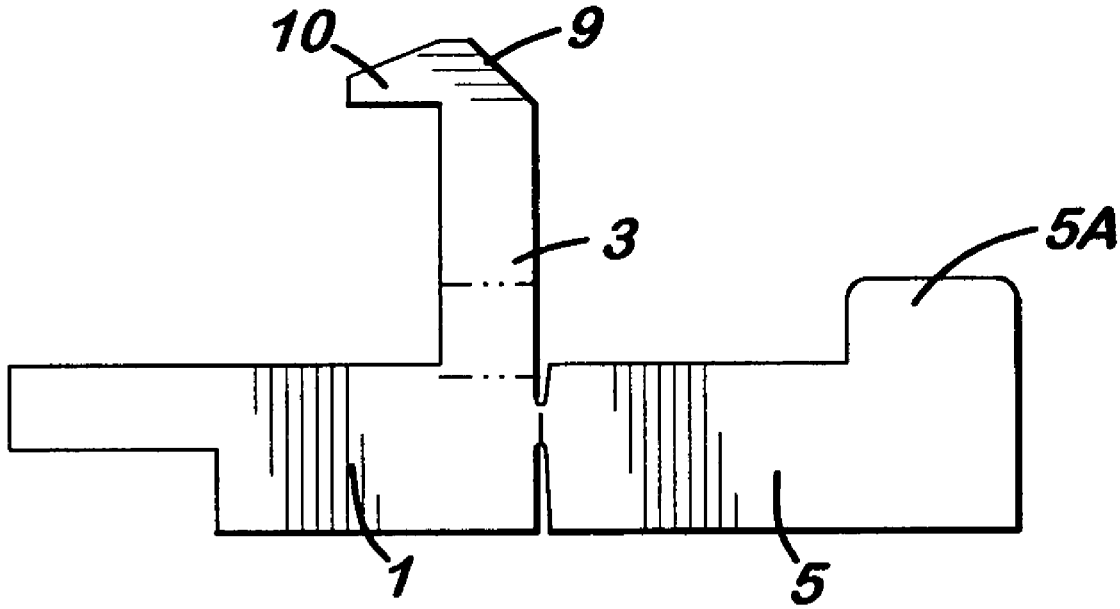

FIGS. 21 and 22 are flat pattern views of the fifth embodiment cut in half to allow a user to use only one side or the other of the fence post anchor. As illustrated in these figures, the embodiment shown in FIG. 17 could be cut in half and sold as two separate pieces so that a person could use one or the other side of the fence post anchor or both pieces together.

Figure 23:
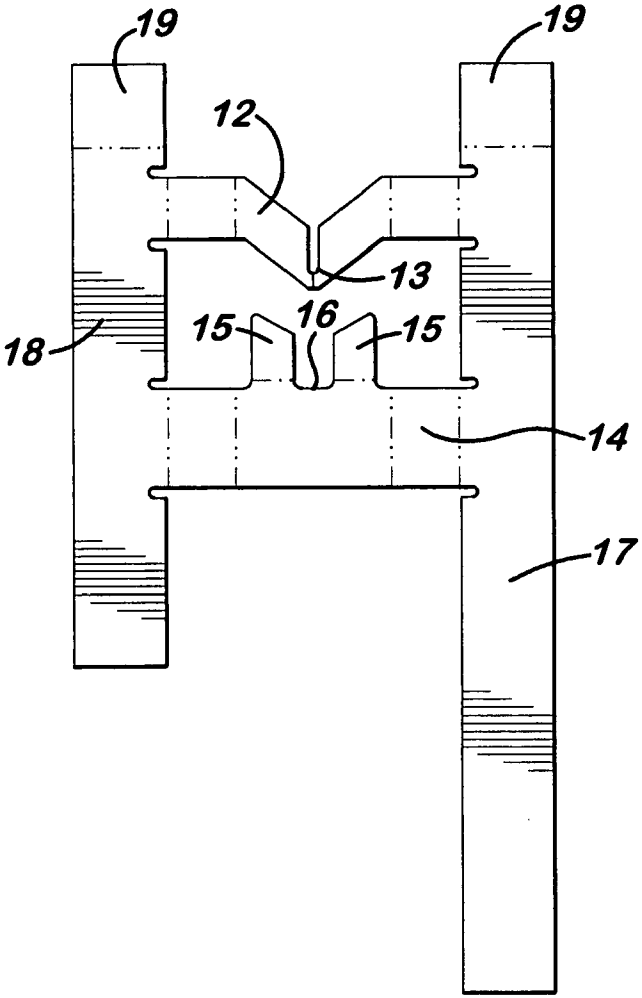
FIG. 23 is a flat pattern view of the sixth embodiment of the present invention.

FIG. 23 is a flat pattern view of the sixth embodiment of the present invention. This figure illustrates the shape of the one-piece material that forms the sixth embodiment of the present invention before it is folded into the configuration shown in FIG. 12. The dotted lines of FIG. 18 indicate where the material is folded to form the pre-installation product shown in FIG. 12.

Figure 24:
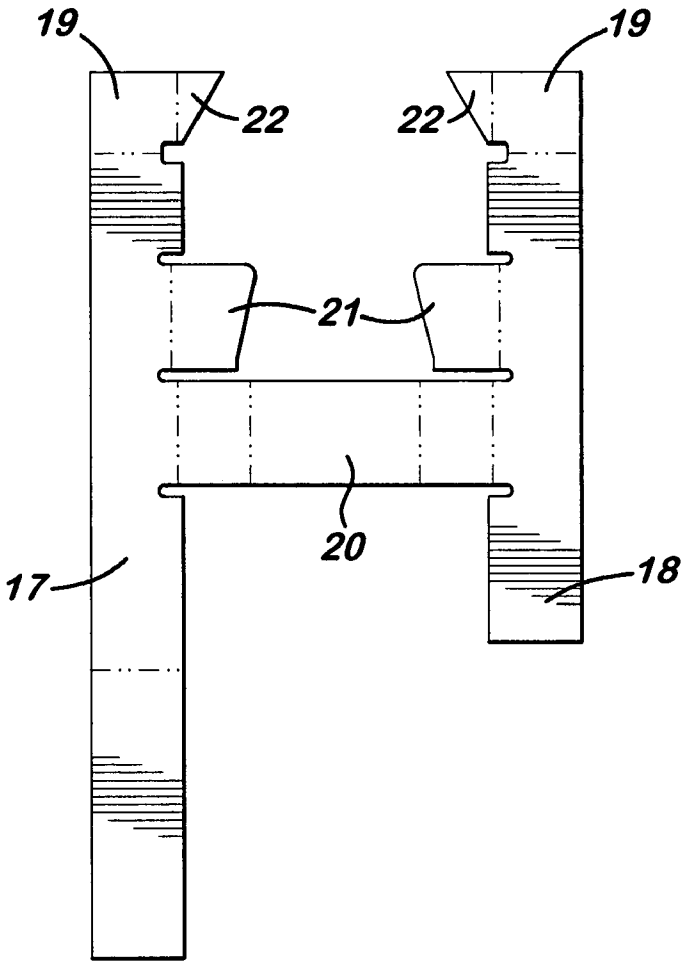
FIG. 24 is a flat pattern view of the seventh embodiment of the present

FIG. 24 is a flat pattern view of the seventh embodiment of the present invention. This figure illustrates the shape of the one-piece material that forms the seventh embodiment of the present invention before it is folded into the configuration shown in FIG. 15. The dotted lines of FIG. 15 indicate where the material is folded to form the pre-installation product shown in FIG. 15.

The present invention could be made of any material that has the requisite strength and durability for the purposes served by the present invention. Some possible materials include stainless steel, hot or cold rolled mild steel, galvanized metal, aluminum and plastic.

The preferred embodiment of the present invention has been shown and described above; however, it will be apparent to those skilled in the art that many changes and modifications may be made without departing from the invention in its broader aspects. The appended claims are therefore intended to cover all such changes and modifications as fall within the true spirit and scope of the invention.

We claim:

1. A fence post anchor for a metal fence post having a bottom end, a front face, and a back end that is perpendicular to the front face, and wherein the back end comprises a first side and a second side, said fence post anchor comprising a single piece of material, wherein the single piece of material comprises:

(e) a first front arm;

(f) a second front arm;

(g) a first rear support member; and (h) a second rear support member;

wherein the first and second rear support members are parallel to but not contiguous with each other prior to installation of the fence post anchor on the fence post;

wherein the first front arm comprises a first end and a second end;

wherein the first end of the first front arm is attached directly to the first rear support member;

wherein the second end of the first front arm is attached directly to the second rear support member;

wherein the second front arm is directly underneath but not contiguous with the first front arm;

wherein the second front arm comprises a first end and a second end;

wherein the first end of the second front arm is attached directly to the first rear support member;

wherein the second end of the second front arm is attached directly to the second rear support member;

wherein the first front arm comprises a front face;

wherein the front face of the first front arm is V-shaped and comprises a centrally situated vertical notch that opens upward;

wherein the second front arm comprises a front face;

wherein the front face of the second front arm comprises two upward extensions that form a notch for receiving a knob on the metal fence post;

wherein the upward extensions are on the same plane as the front face of the second front arm;

wherein when the fence post anchor is installed on the metal fence post, the front face of the first front arm, the front face of the second front arm, and the upward extensions are all parallel with the front face of the metal fence post;

wherein the second rear support member comprises a first portion, a second portion, and a third portion;

wherein when the fence post anchor is installed on the metal fence post, the first rear support member is parallel to and abuts longitudinally the first side of the back end of the metal fence post;

wherein the first rear support member comprises an outer face;

wherein when the fence post anchor is installed on the metal fence post, the first portion of the second rear support member is parallel to and abuts longitudinally the second side of the back end of the metal fence post, the second portion of the second rear support member wraps around the bottom end of the metal fence post, and the third portion of the second rear support member is parallel to and abuts longitudinally the outer face of the first rear support member; and wherein the first and second rear support members each comprises a top end and a flange that extends vertically outward from the top end of the rear support member when the fence anchor post is installed on the metal fence;

wherein the V-shaped front face of the first support arm comprises a bottom point that is centered on the front face of the metal fence post; and wherein when the fence post anchor is installed on the metal fence post, and the metal fence post is pulled upward, the knob on the front face of the metal fence post engages the bottom point of the V-shaped front face of the first support arm, thereby causing the first and second rear support members to bend away from the back end of the metal fence post at a point between the point at which the first front support arm is attached to the rear support member and the point at which the second front support arm is attached to the rear support member.

2. The fence post anchor of claim 1, in combination with said metal fence post.

3. The fence post anchor of claim 1, in combination with said metal fence post, wherein the metal fence post comprises a plurality of evenly spaced knobs on the front face of the metal fence post, and wherein one of said knobs fits into the notch between the two upward extensions.

4. The fence post anchor of claim 3, in combination with said metal fence post, wherein the knob that fits into the notch is the bottom-most knob on the metal fence post.

5. The fence post anchor of claim 1, in combination with said metal fence host, wherein the metal fence post comprises a plurality of evenly spaced knobs on the front face of the metal fence post, and wherein the first and second front arms do not extend horizontally beyond the knobs on the front face of the metal fence post.

6. The fence post anchor of claim 1, wherein the single piece of material is stainless steel.

7. The fence post anchor of claim 1, wherein the single piece of material is hot rolled mild steel.

8. The fence post anchor of claim 1, wherein the single piece of material is cold rolled mild steel.

9. The fence post anchor of claim 1, wherein the single piece of material is galvanized metal.

10. The fence post anchor of claim 1, wherein the single piece of material is aluminum.

11. The fence post anchor of claim 1, wherein the single piece of material is plastic.

12. A method of anchoring a fence post in the ground, comprising the steps of: providing the fence post anchor of claim 1, placing the fence post anchor on the fence post, and placing the fence post in the ground.

13. A method of manufacturing the fence post anchor of claim 1, comprising the steps of: cutting a single piece of material in a pattern that can be folded into the shape of the fence post anchor; and folding the single piece of material into the shape of the fence post anchor, such that the single piece of material forms the fence post anchor for a metal fence post having a bottom end, a front face, and a back end that is perpendicular to the front face, and wherein the back end comprises a first side and a second side, wherein the single piece of material comprises:

(a) a first front arm;

(b) a second front arm;

(c) a first rear support member; and (d) a second rear support member wherein the first and second rear support members are parallel to but not contiguous with each other prior to installation of the fence post anchor on the fence post;

wherein the first front arm comprises a first end and a second end;

wherein the first end of the first front arm is attached directly to the first rear support member;

wherein the second end of the first front arm is attached directly to the second rear support member;

wherein the second front arm is directly underneath but not contiguous with the first front arm;

wherein the second front arm comprises a first end and a second end;

wherein the first end of the second front arm is attached directly to the first rear support member;

wherein the second end of the second front arm is attached directly to the second rear support member;

wherein the first front arm comprises a front face;

wherein the front face of the first front arm is V-shaped and comprises a centrally situated vertical notch that opens upward;

wherein the second front arm comprises a front face;

wherein the front face of the second front arm comprises two upward extensions that form a notch for receiving a knob on the metal fence post;

wherein the upward extensions are on the same plane as the front face of the second front arm;

wherein when the fence post anchor is installed on the metal fence post, the front face of the first front arm, the front face of the second front arm, and the upward extensions are all parallel with the front face of the metal fence post;

wherein the second rear support member comprises a first portion, a second portion, and a third portion;

wherein when the fence post anchor is installed on the metal fence post, the first rear support member is parallel to and abuts longitudinally the first side of the back end of the metal fence post;

wherein the first rear support member comprises an outer face;

wherein when the fence post anchor is installed on the metal fence post, the first portion of the second rear support member is parallel to and abuts longitudinally the second side of the back end of the metal fence post, the second portion of the second rear support member wraps around the bottom end of the metal fence post, and the third portion of the second rear support member is parallel to and abuts longitudinally the outer face of the first rear support member; and wherein the first and second rear support members each comprises a top end and a flange that extends vertically outward from the top end of the rear support member when the fence anchor post is installed on the metal fence;

wherein the V-shaped front face of the first support arm comprises a bottom point that is centered on the front face of the metal fence post; and wherein when the fence post anchor is installed on the metal fence post, and the metal fence post is pulled upward, the knob on the front face of the metal fence post engages the bottom point of the V-shaped front face of the first support arm, thereby causing the first and second rear support members to bend away from the back end of the metal fence post at a point between the point at which the first front support arm is attached to the rear support member and the point at which the second front support arm is attached to the rear support member.

* * * * *